United States Patent [19]

Ware

[11] 4,400,001

[45] Aug. 23, 1983

[54] ROLLER SKATE

[75] Inventor: Gordon K. Ware, Chicago, Ill.

[73] Assignee: Chicago Roller Skate Company, Chicago, Ill.

[21] Appl. No.: 278,855

[22] Filed: Jun. 29, 1981

[51] Int. Cl.[3] ..... A63C 17/02

[52] U.S. Cl. ..... 280/11.28

[58] Field of Search ..... 280/11.28, 11.27, 11.19, 280/11.2

[56] References Cited

U.S. PATENT DOCUMENTS

| | | | |
|---|---|---|---|
| 2,341,576 | 2/1944 | Shye | 280/11.27 |
| 2,373,220 | 4/1981 | Blaes | 280/11.27 |
| 2,664,295 | 12/1953 | Van Horn | 280/11.28 |
| 3,180,651 | 4/1965 | Ware | 280/11.2 |
| 3,343,744 | 4/1981 | Shevelson | 280/11.2 |
| 3,862,763 | 1/1975 | Ware | 280/11.28 |
| 4,058,321 | 11/1977 | Ware, Jr. | 280/11.1 |
| 4,181,227 | 1/1980 | Balstad | 280/11.2 |
| 4,295,655 | 10/1981 | Landay et al. | 280/11.28 |
| 4,345,774 | 8/1982 | Poe et al. | 280/11.28 |

*Primary Examiner*—David M. Mitchell

*Attorney, Agent, or Firm*—Trexler, Bushnell & Wolters, Ltd.

[57] ABSTRACT

There is disclosed an improved roller skate having a unitary soleplate. The roller skate includes a pair or truck assemblies secured to the bottom surface of the soleplate at the toe portion and at the heel portion by a threaded fastener. The soleplate has an aperture for receiving each threaded fastener and a recess for receiving and confining an enlarged end portion of the fastener, and slot means in the soleplate, communicating with the aperture and the recess, allow insertion of the threaded fastener from the bottom of the soleplate.

3 Claims, 5 Drawing Figures

10
12
14
16
18
20
22
24
26
28
32
32a
34
34a
36
36a
38
38a
40
40a
42
42a
44
45
46
46a
47
47a
48
48a
49
49a
50
50a
52
54
56
58
60
70
72
74
76
76a 60
62
64
66
68
78
80
80a
82

28
50
50a
54
60
66
70
72
74
76
76a
80
82

5
72
74
76
78
80
82

44
45
47
76
78
80
82

ROLLER SKATE

BACKGROUND OF THE INVENTION

This invention relates generally to roller skates and more particularly to a new and improved roller skate soleplate.

Roller skates of the kind to which the present invention is directed are generally provided with a shoe structure secured to a soleplate. From this soleplate, front and rear wheel support assemblies, known as roller trucks, depend and are secured to the soleplate by means of fastener assemblies known as action screws. In the past, soleplates have included a threaded bore to threadingly receive the action screw which secures the wheel support assembly. However, threaded bores formed in the soleplate itself have the disadvantage of requiring the replacement of the entire soleplate if the threads are damaged due to inadvertent cross threading of the fastener assembly during periodic replacement of the wheel support assemblies.

In other instances, the fastener assembly has been inserted through the soleplate from the top surface thereof prior to the attachment of the shoe structure. However, replacement of the fastener assembly, as may be required, necessitates the removal of the shoe structure from the soleplate to provide access to the fasteners therein.

It is therefore an object of the present invention to provide a new and improved soleplate for a roller skate.

It is a further object of the present invention to provide a soleplate for a roller skate which allows the insertion and installation of a threaded fastener for the attachment of a wheel support assembly from the bottom of the soleplate.

It is a still further object of the present invention to provide a soleplate for a roller skate which enables the attachment of the wheel support assemblies without threading the soleplate and without the removal of the shoe structure therefrom.

Other objects and advantages of the invention will become apparent upon reading the following detailed description and upon reference to the drawings.

SUMMARY OF THE INVENTION

The present invention therefore provides a unitary soleplate adapted to receive a wheel support assembly and a wheel support fastener at a bottom surface thereof, the soleplate including a recess dimensioned for receiving and confining an enlarged end portion of the fastener assembly, and slot means enabling the insertion of the fastener assembly.

DESCRIPTION OF THE PREFERRED EMBODIMENT

While the invention will be described in connection with a preferred embodiment, it will be understood that the invention is not intended to be limited by this description. On the contrary, the invention is intended to cover all alternatives, modifications and equivalents as may be included within the spirit and scope of the invention as defined by the appended claims.

Figure 1:
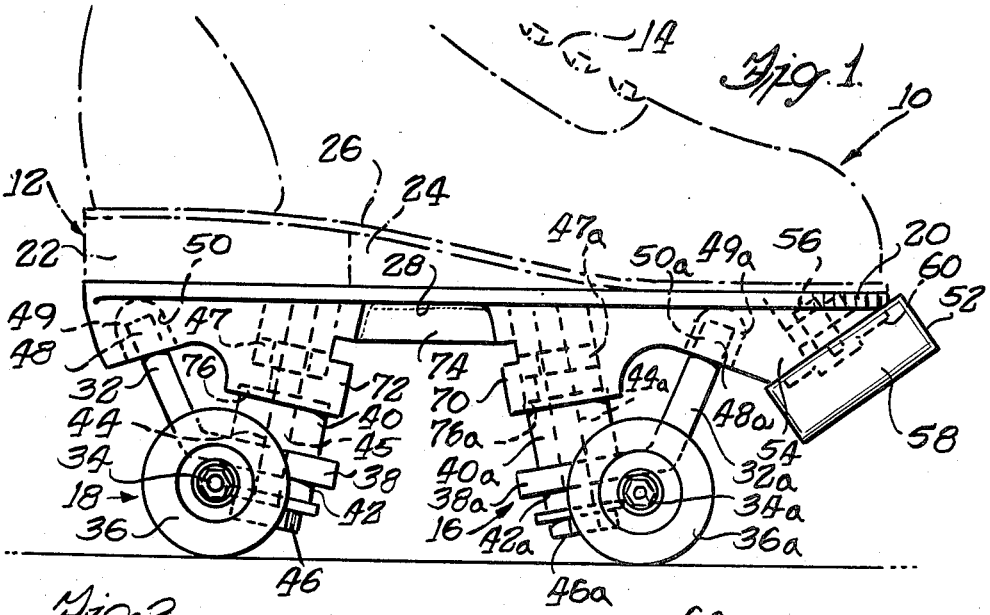
FIG. 1 is a side elevational view showing the soleplate of the present invention together with a shoe structure, supporting roller trucks and a toe stop.

Referring now to FIG. 1, a roller skate 10 embodying the present invention is illustrated, and comprises a unitary soleplate 12, a shoe structure 14, and front and rear wheel support assemblies, also known as roller trucks, 16 and 18 respectively. The soleplate 12 includes a toe portion 20, a heel portion 22 and an instep portion 24 therebetween. The soleplate 12 further defines a top surface 26 and a bottom surface 28 from which the truck rollers 18 and 16 depend.

Since the front and rear wheel support assemblies 16 and 18 are substantially identical, only the rear wheel support assembly 18 and its associated parts and mounting arrangement will be described in detail. However, like reference numerals, including the subscript a, will be applied to the front wheel support assembly 16.

The wheel support assembly 18 includes a strut arm 32 which includes an integrally-formed truck housing to support an axle 34. The axle 34 in turn supports wheels or rollers which are mounted thereon, as indicated by the wheel 36.

At a lower end 38 and on opposite sides of the strut arm 32 are disposed a pair of cushion members 40 and 42 which, along with the strut arm 32, receive an action screw or fastener assembly 44 including an elongate shank 45, which coacts with a nut 46 to secure the lower end 38 of the strut arm 32 to the bottom surface 28 of the soleplate 12. An enlarged end portion 47 of the rod member 44 is disposed in the soleplate 12, as more fully hereinafter described. The wheel support assemblies 16, 18 are additionally supported by an upper end 48 of the strut arm 32 which is detachably received in a resilient bushing 49 contained in a socket 50 in the soleplate 12.

The soleplate 12 also includes a toe stop structure 52 mounted on a front embossment 54 thereof. This toe stop structure may take the form of that disclosed in U.S. Pat. No. 3,180,651 and includes a fastener assembly 56, and a stop member 58 which may be compressibly secured against the ridges 60 in the embossment 54 as described in the aforementioned U.S. Patent.

Figure 2:
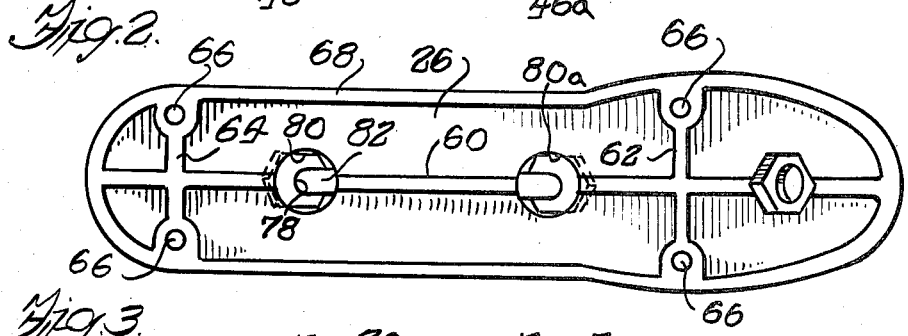
FIG. 2 is a top plan view of the soleplate shown in FIG. 1.

Turning now to FIG. 2, it will be noted that the soleplate 12 includes a longitudinal rib 60 and transverse ribs 62 and 64 to render the soleplate 12 light in weight yet strong and durable in construction. Also included are a plurality of bores, represented by the reference numeral 66, which accommodate elongate rivets or other suitable means for securing the shoe structure 14 to the soleplate 12. In combination, the ribs 62, 64 and a sidewall 68 provide support for the shoe structure 14.

Figure 3:
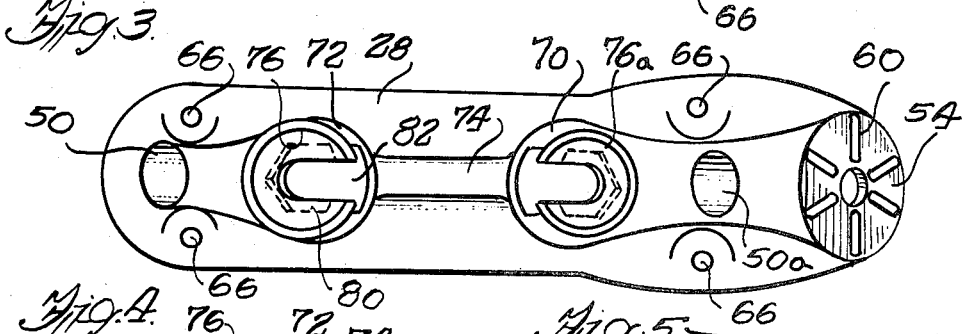
FIG. 3 is a bottom plan view of the soleplate of the instant invention.

As is shown generally in FIG. 1 and more specifically in FIG. 3, the soleplate 12 includes a first embossment 70 and a second embossment 72 for the mounting of the front and rear wheel support assemblies 16 and 18, respectively.

Figure 4:
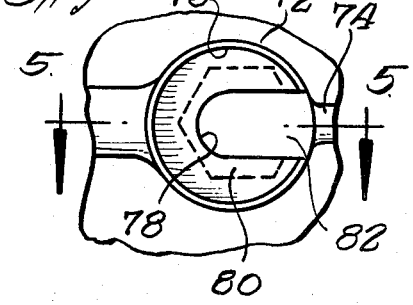
FIG. 4 is an enlarged fragmentary bottom view of the rear embossment shown in FIG. 3.
Figure 5:
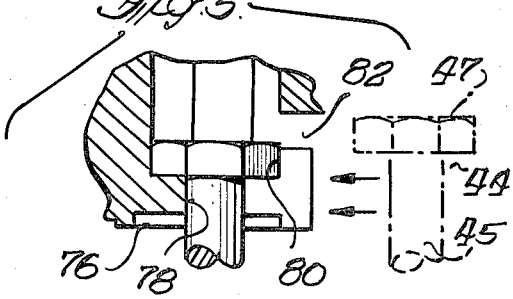
FIG. 5 is a sectional view taken along the line 5—5 in FIG. 4.

Description of the embossments 70, 72 and the associated wheel support structure will be limited to that of the second embossment 72 and the wheel structure assembly 18, as shown in FIGS. 4 and 5. However, the first embossment 70 and wheel support assembly 16 are essentially similar and will be referenced with like numerals including the subscript a.

Turning now to FIG. 3, the embossment 72 is seen to include an annular socket 76 to limit radial movement of the cushion 40 and to further secure the wheel support assembly 18 to the soleplate 12.

The construction of the embossment 72 advantageously enables the insertion and removal of the fastener assembly 44, and thus the replacement of the wheel support assembly 18, without the removal of the shoe 14 from the soleplate 12. Thus, the shoe may be permanently affixed to the soleplate 12 through means known in the art to afford a roller skate of superior strength and durability. Yet, the fastener assembly 44 may be easily removed as desired.

As is seen in FIGS. 3 and 4 the embossment 72 includes an aperture 78 for supporting the fastener assembly 44, a hexagonal recess 80 for confining the end portion 47 of the assembly 44, and a slot 82 proportioned to allow the passage of the assembly 44, including the shank portion 45 and the end portion 47 thereof. As is more fully shown in FIG. 5, the slot 82 includes a transverse upper portion to allow the passage of the enlarged end portion 47.

When the fastener assembly 44 is received in the aperture 78, a downward movement, such as by threading the nut 46 on the shank 45, seats the end portion 47 in the hexagonal recess 80. The recess 80 firmly holds the end portion 47 and allows the final tightening of the nut 46 without external restraining means such as wrenches or the like. The nut 46 may be of a self-locking construction or may be used with locking washers as desired.

It is to be understood that either the end portion 47 or the nut 46 may be received in the recess 80 with equal facility, dependent upon the design of the soleplate, wheel assembly and action screws.

Thus, in the event that repairs to the wheel support assembly are required, the entire assembly may be removed by loosening the nut 46 and detaching the upper end 48 of the strut arm 32 from the socket 50. The fastener assembly 44 may be removed from its position in the soleplate and replaced through the slot 82 if the threads are damaged or if the replacement truck requires a different length of fastener assembly.

While particular embodiments of the present invention have been shown and described, modifications may be made and it is therefore intended to cover in the appended claims all such changes and modifications which fall within the true spirit and scope of the invention.

The invention is claimed as follows:

1. A soleplate for a roller skate of the type including a truck assembly securable to the soleplate by a fastener assembly, said fastener assembly including an elongated shank member having a threaded end portion, said fastener assembly further including as components a head at an opposite end of said shank member and a nut engageable with the threaded end portion, the soleplate comprising: a unitary member having a top surface and a bottom surface, said unitary member including an embossment integral with and depending from said bottom surface, said embossment including an aperture through a bottom end thereof for receiving said shank member in a position depending from the soleplate, said aperture including axially aligned first and second portions respectively of first relatively large predetermined and second relatively small predetermined transverse dimensions and a seat between said first and second portions, at least one of the components having transverse dimensions less than said first and greater than said second predetermined transverse dimensions, said aperture further including a slot substantially transverse to said first and second portions and communicating therewith axially above said seat for passing one of said components and said shank member to said first and second portions during assembly of the fastener assembly with the soleplate, said one component having a side surface, said first portion having a surface engageable with said surface of said one component for preventing rotation of said component, said one component being movable through said slot, into said first portion and thence axially toward said second portion for engagement with said seat when fully assembled with said soleplate, tightening of said nut on said threaded portion causing the shank member to be non-rotatably and positively secured to said soleplate.

2. The soleplate of claim 1 wherein said head is integral with said shank member; wherein the axis of said head is co-linear with the axis of said shank member; wherein said head and said first portion are hexagonal in transverse cross section, said first portion having relatively greater transverse dimensions than said head; and wherein said nut is relatively greater in transverse dimension than said second portion.

3. The soleplate of claim 1 wherein said head is integral with said shank member; wherein the axis of said nut is co-linear with the axis of said shank member when said nut is engaged with said threaded end portion of said shank member; wherein said nut and said first portion are hexagonal in transverse cross section, said first portion having relatively greater transverse dimensions than said nut; and wherein said head is relatively greater in transverse dimensions than said second portion.

* * * * *